US005427315A

United States Patent [19]

Lipson

[11] Patent Number: 5,427,315

[45] Date of Patent: Jun. 27, 1995

[54] DRINKING STRAW WITH INSERT

[76] Inventor: Erik Lipson, 1530 Locust St. #10B, Philadelphia, Pa. 19102

[21] Appl. No.: 231,813

[22] Filed: Apr. 25, 1994

[51] Int. Cl.[6] ..... A47G 21/18

[52] U.S. Cl. ..... 239/33; 239/71

[58] Field of Search ..... 239/16, 24, 33, 71; 40/316; 281/51; 283/117; 267/169

[56] References Cited

U.S. PATENT DOCUMENTS

| | | | |
|---|---|---|---|
| 2,063,803 | 12/1936 | Gildersleeve | 239/33 |
| 2,619,770 | 12/1952 | Dinhofer | 239/33 X |
| 3,425,626 | 2/1969 | Dietz et al. | 239/33 |
| 3,517,884 | 6/1970 | Horvath | 239/33 |
| 3,606,156 | 9/1971 | Homorodean, Jr. et al. | 239/33 |
| 4,379,372 | 4/1983 | Alexander et al. | 40/316 X |
| 4,539,767 | 9/1985 | Jaffe | 40/316 |
| 4,576,336 | 3/1986 | Cohen et al. | 239/33 |
| 4,726,518 | 2/1988 | Martina et al. | 239/33 |
| 5,184,774 | 2/1993 | Lipson | 239/33 |

FOREIGN PATENT DOCUMENTS

| | | | |
|---|---|---|---|
| 350468 | 1/1990 | European Pat. Off. | 239/33 |
| 3407733 | 9/1985 | Germany | 239/33 |
| 2032756 | 5/1980 | United Kingdom | 239/33 |

*Primary Examiner*—William Grant

*Attorney, Agent, or Firm*—Gifford, Krass, Groh, Sprinkle, Patmore, Anderson & Citkowski

[57] ABSTRACT

A novelty drinking straw which includes a planar insert for the display of amusement or advertising indicia thereon. The straw includes a drinking tube having linearly extending first and second ends, and a loop disposed therebetween. The loop passes through more than 360° of arc for a distance to define a doubled portion of the loop including an inner and an outer passage. The outer passage terminates in a transverse attachment portion. A planar insert is attached to the loop by means of a first cut-out portion through which the attachment portion of the loop passes. At least one section of the insert is sandwiched between the inner and outer passages so that the insert is prevented from rotating substantially out of the plane of the loop.

14 Claims, 2 Drawing Sheets

FIG-6
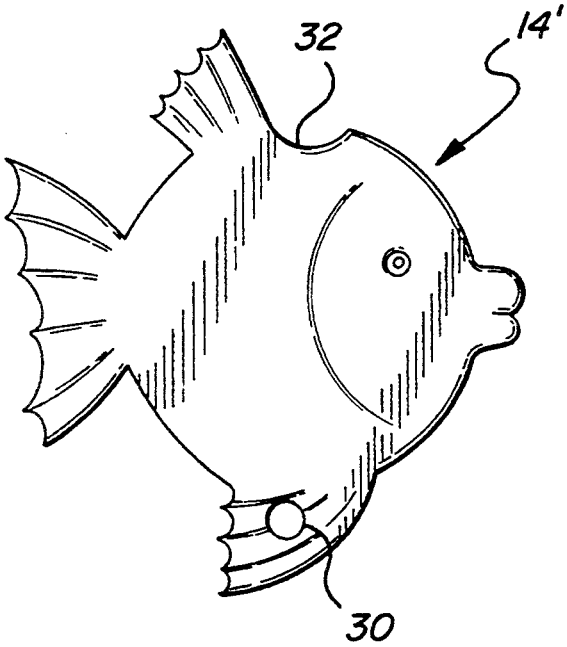
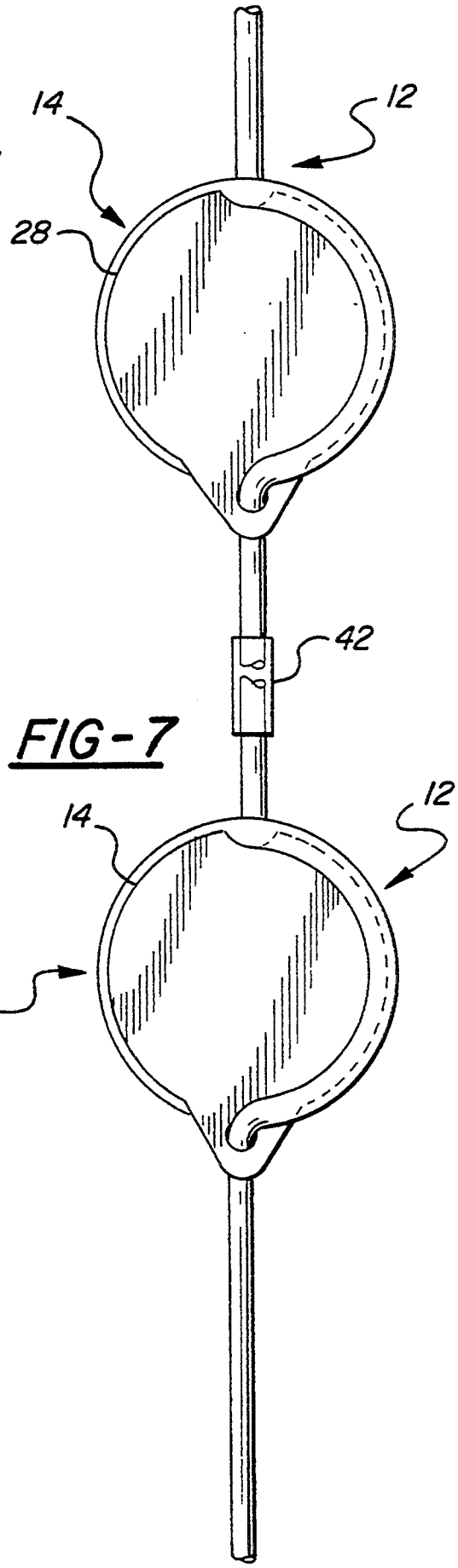
FIG-7
FIG-8
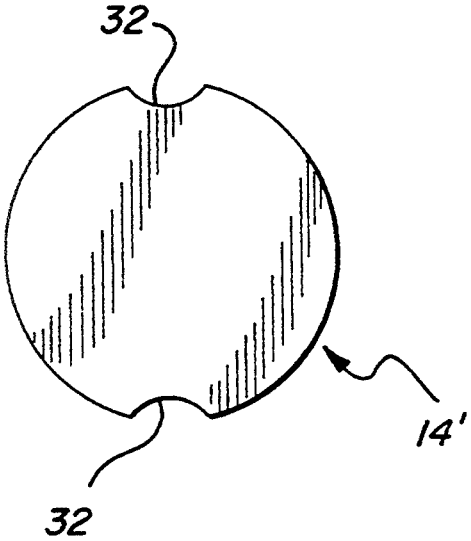

DRINKING STRAW WITH INSERT

FIELD OF THE INVENTION

The present invention concerns the field of novelty drinking straws and, more particularly, to such a drinking straw which includes an insert carrying advertising or amusement material thereon.

BACKGROUND OF THE INVENTION

There are many novelty drinking straws made and sold every year. These novelty drinking straws include drinking passages which are in the form of loops, spirals, flowers, stick figures, eye glasses, etc. Some examples of patents disclosing such novelty drinking straws include: U.S. Pat. Nos. 2,063,803; 2,557,411; 2,619,770; 3,260,462; 3,326,695; 3,425,626; 3,517,884; 3,606,156; 3,773,256; 3,957,202; 4,374,596; 4,687,306; 4,699,319; 4,828,355; and 5,184,774. Such novelty drinking straws are intended to amuse the users (principally children) by attracting their attention to the visual display made when fluid passes through the drinking tube as the straw is used.

Novelty drinking straws are also known which include a panel for displaying a message such as an advertisement. In particular, U.S. Pat. No. 4,726,518 discloses such a novelty straw. The straw disclosed in the '518 patent is of a particular construction including a panel having two opposed, flat major faces for the display of indicia thereon, a plurality of channels extending between the major faces and having open ends at opposite sides of the panels, and at least one mouthpiece and one liquid pick-up region formed at the ends of the straw and interconnected by at least two of the panels. As disclosed in the patent, the channels extend linearly up and down from the panel to form the mouthpiece and liquid pick-up region. The patent does not discuss how the straw is formed. It appears from FIGS. 3 and 5 that the entire straw may be integral in construction and possibly extruded and/or molded in some fashion. Clearly, the straw disclosed in this patent has only limited appeal since the drinking tube, itself, is only linear in configuration.

What is needed is a novelty drinking straw on which advertising or amusement material may be displayed, which has a single, convoluted drinking passage, and which is amusing to use. What is further needed is such a novelty drinking straw which is easy and inexpensive to manufacture. Additionally it would be particularly advantageous if such a drinking straw included the ability to remove and replace the inserts.

SUMMARY OF THE INVENTION

Disclosed and claimed herein is a novelty drinking straw designed to overcome the disadvantages of the prior art noted above. The drinking straw includes a drinking tube defining a hollow, continuous flow passage. The drinking tube includes first and second linearly extending end portions, one of the first or second end portions defining a mouthpiece and the other defining a liquid pick up region. Disposed in the flow passage between the first and second linear end portions is a loop which defines a plane. The loop extends through more than 360° of arc and doubles back on itself for a distance to create a doubled portion of the loop. The double loop portion includes an inner and an outer passage, and the outer passage terminates in an attachment portion which extends transverse with respect to the plane of the loop. The attachment portion is connected to one of the first or second end portions (that is, it may be connected to the mouthpiece, or it may be connected to the liquid pick up region).

A planer insert including a panel bearing indicia is disposed in said loop. The panel includes at least a first cutaway portion (typically, a notch or aperture) through which said attachment portion is threaded so that the insert is retained by the loop. The insert further includes at least one section thereof which extends beyond the loop and is sandwiched between the inner and outer passages so that the insert is prevented from rotating substantially out of the plane of the loop.

The panel may be circular in configuration, or it may have a more complex shape; in both cases it will be appropriately sized so that at least a section of its edge portion is caught between the two passages of the double loop. If it has a more specialized shape (such as the shape of an animal, flower, etc.), a plurality of sections thereof may extend beyond the circle of the loop.

In a preferred embodiment, the insert further includes a second cutaway portion formed in said panel and disposed for engagement with a portion of the drinking tube loop. Typically, if the attachment portion of the loop is connected to the mouthpiece, then the second cutaway portion (typically a notch) will be engaged with a portion of the loop proximate the second end or liquid pickup region of the drinking tube. The loop may further include a second attachment portion transverse with respect to said plane for engagement with the second cutaway portion. The second attachment portion will connect with the other of said first and second end portions. In other words, if the first attachment portion is connected with the mouthpiece, the second attachment portion will connect with the liquid pickup region and vice versa.

The transverse attachment portion or portions may pass radially inboard of the inner passage of the loop, or they may pass radially outboard. Furthermore, the loop may pass through additional increments of 360° of arc to form a triple, quadruple, etc. loop portion. In the case of the triple loop portion, it will define inner, outer and middle passages. The section of the insert will be caught between the middle portion and one of either the inner or outer passages.

The insert may further include a plurality of panels, each having a first cutaway portion (typically an aperture) formed therein for engagement with the attachment portion of the loop. One of the plurality of panels may then be rotated in the plane with respect to the other of said panels so that different messages on the face of the panels may be viewed in sequence. In another embodiment, one of the plurality of panels is fixed with respect to the loop (by such means as glue, tape, etc.).

In another preferred embodiment, the fixed panel described above includes at least one slot, and the rotating panel includes at least one flap which extends through the slot to create a changing visual impression as the panel is rotated through the plane with respect to the fixed panel. This feature may further excite the interest of the user and enables the display of more complex and creative messages.

In yet another embodiment, the straw includes a plurality of drinking tubes each having an associated insert. Each of the plurality of tubes has means disposed on either the first or second end thereof for connection to the first or second ends of other of the tubes so that the user may use the drinking tubes to construct different flow passageways. U.S. Pat. No. 5,184,774 in the name of the same inventor as that of the present invention, discloses the concept of a plurality of connector straws which may be connected together by the user to create different passageways; the disclosure of Pat. No. 5,184,774 is hereby incorporated by reference.

BRIEF DESCRIPTION OF THE DRAWINGS

The following detailed description is best understood by reference to the following drawings in which:

FIG. 6 is another embodiment of an insert suitable for use in the drinking straw of the present invention;

FIG. 7 is yet another embodiment of the drinking straw of the present invention; and FIG. 8 is another embodiment of an insert suitable for use in the drinking straw of the present invention.

DETAILED DESCRIPTION OF THE PREFERRED EMBODIMENTS

Figure 1:
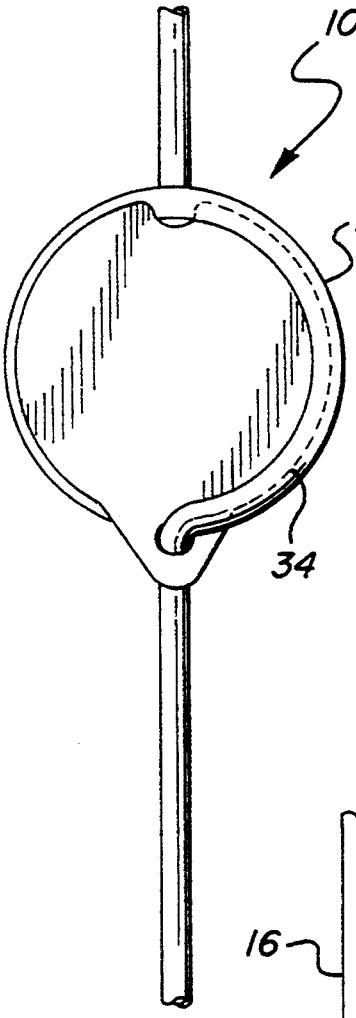
FIG. 1 is a front view of a novelty drinking straw constructed in accord with the present invention.
Figure 2:
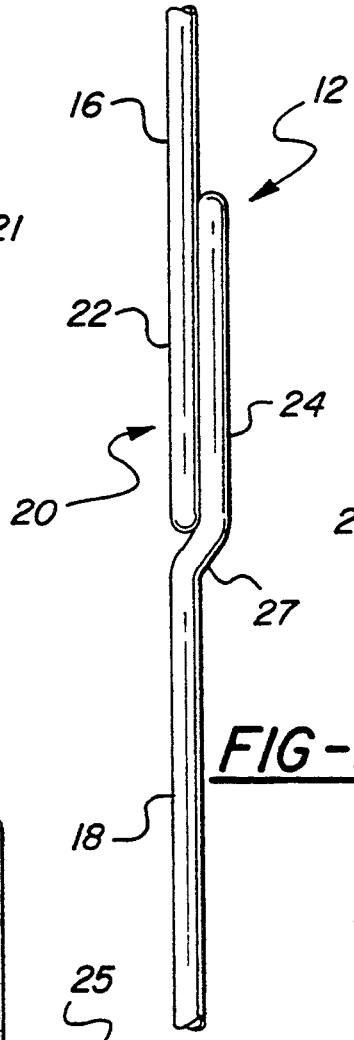
FIG. 2 is a side view of the drinking tube of FIG. 1 with the insert removed.

Throughout the following detailed description, like numerals are used to reference the same element of the present invention shown in multiple figures thereof. Referring now to the drawings, and in particular to FIGS. 1–4, there is shown a novelty drinking straw 10 according to the present invention. The drinking straw 10 includes a drinking tube 12 which defines a hollow, continuous passage for the flow of liquid therethrough and an insert 14.

The drinking tube 12 includes first and second linearly extending end portions 16,18, the first end portion 16 defining a mouthpiece, and the second end portion 18 defining a liquid pickup region. A loop 20 which defines a plane is disposed in said drinking tube 12 at a point medial of said first and second end portions 16,18. The loop 20 passes through 540° of arc to define a semi-circular, double loop portion 25 including an inner passage 22 and an outer passage 24. As can best be seen in FIGS. 2 and 4, the outer passage 24 terminates in an attachment portion 27 which is oriented substantially transverse with respect to the plane of the loop 20. The attachment portion 27 connects to the second end portion 18.

Preferably, the drinking tube 12 is formed of a flexible, resilient shape retaining material such as polyethylene tubing. This permits easy insertion and removal of the insert as will subsequently be described.

The insert 14 is planar in configuration and includes a panel 28 for the display of a message thereon. The panel 28 includes first and second cutaway portions 30,32 which are disposed diametrically opposite thereon. In the embodiment shown in FIGS. 1–4, the first cutaway portion 30 is an aperture, and the second cutaway portion 32 is a notch. However, the insert 14 could include only one cutaway portion in the form of either a notch, aperture, slit, etc., or it could also include first and second cutaway portions which are both notches or slits. The invention is not limited to the precise embodiment of an aperture 30 and a diametrically opposite notch 32 as depicted.

Figure 3:
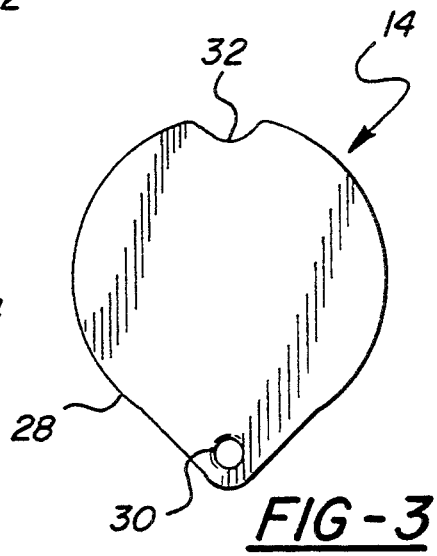
FIG. 3 is a front view of the insert of the novelty drinking straw of FIG. 1.
Figure 4:
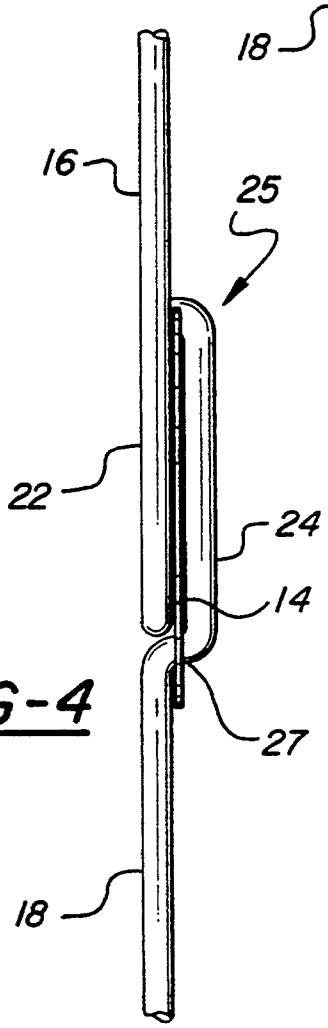
FIG. 4 is a side view similar to FIG. 2 but with the passages of the loop spread apart to show the insert installed therein.

As can best be seen with reference to FIGS. 1 and 3, the first cutaway portion 30 is for engagement with the attachment portion 27 of the drinking tube 12; thus, the attachment portion 27 extends through the first cutaway portion 30. In this manner, the insert 14 is mounted to the drinking tube 12. The second cutaway portion 32, if present as in the depicted embodiment, is for engagement with the loop 20. This helps to firmly fix the insert 14 in place. Additionally, at least one section 21 of the panel 28 is sandwiched between the inner and outer passage 22,24, as can best be seen by reference to FIG. 4. Because section 21 is sandwiched between inner and outer passages 22,24 the insert 14 is prevented from rotating substantially out of the plane of the loop 20. It is a simple matter to install the insert 14 in the tube 12, as well as to remove and replace it with a different insert, should that be desired.

Indicia in the form of drawings and/or alpha-numeric data is preferably disposed on the insert 14. The purpose of the indicia is to draw the user's attention so as to convey either an advertising message, or simply an aesthetic or humorous impression. Thus, the insert 14 may be variously configured. In the embodiment depicted in FIGS. 1–4, it is shown as a rough circle, with the section 21 which is caught between the passages 24,26 being adjacent the periphery of the panel 28. However, FIG. 6 illustrates how an insert 14' can have a different configuration, in this case the shape of a fish. The insert 14' of the embodiment shown in FIG. 6 also includes first and second cutaway portions 30,32 in the form of an aperture and a notch. The insert 14" of FIG. 8 shows a version with two opposed notches 32, 32". Although it differs in shape, the insert 14' of FIG. 6 is installed inside the drinking tube 12 in precisely the same manner as that depicted for the insert 14 shown in FIGS. 1 and 4. Because of its novelty shape, some of the insert 14' of FIG. 6 will obviously extend through the inner and outer passages of the drinking tube.

Figure 5:
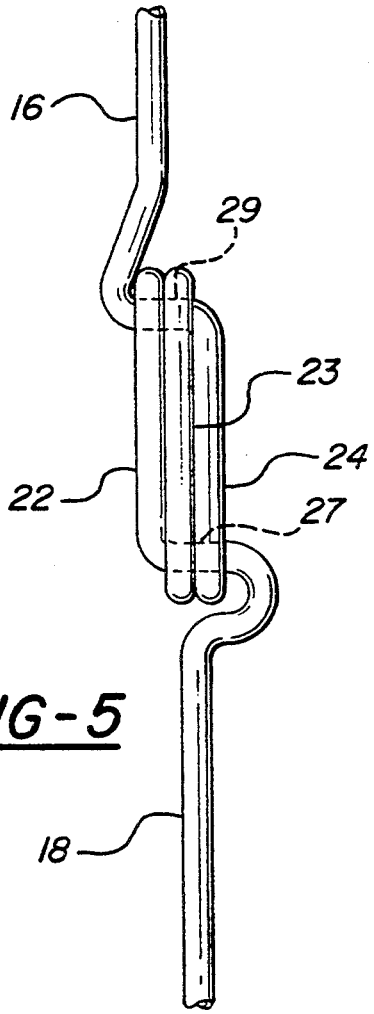
FIG. 5 is a side view of another embodiment of the novelty drinking straw of the present invention.

The embodiment depicted in FIGS. 1–4 illustrates a drinking tube including a loop which passes through 540° of arc, thus creating a tube having a double walled passage on half of its circuit, and a single wall passage on the other half. However, the loop can be configured differently, such as is depicted in FIG. 5. In the embodiment depicted in FIG. 5, the loop 20 passes through an additional 360° of arc so that it defines a semi-circular portion having triple passages, including inner, middle and outer passages 22,23,24. Thus, rather than a loop having a double passage on one half and a single passage on the other half, the loop 20 of FIG. 5 includes a triple passage on one half and a double passage on the other half. Accordingly, an insert (not depicted) installed therein will have virtually its entire periphery sandwiched between passages of the more complex loop. Obviously, such a loop could pass through further increments of 360° of arc to form quadruple, quintuple, etc. passages. FIG. 5 also shows a second attachment portion for engagement with cutaway portion 32.

In the embodiment depicted in FIGS. 1–4, the attachment portions 27,29 pass radially outboard of the inner passage 22. However, they may equally well pass radially inboard of the inner passage 22 (as well as the middle passage 23) as is shown in phantom in the triple passage embodiment of FIG. 5. However, the double passage embodiment of FIG. 2 could equally well include a radially inboard attachment section 27, and the triple passage embodiment shown in FIG. 5 could be constructed with a radially outboard attachment section 27.

FIG. 7 depicts another alternate embodiment 40 of the novelty drinking straw of the present invention. Drinking straw 40 includes a plurality of drinking tubes 12, each having an insert 14, which are connected together via a connector 42 of the type described in U.S. Pat. No. 5,184,774. By providing a plurality of individual components, the user may connect them in any sequence desired to create more novelty effects.

The insert 14 may also include additional features. For example, it may have a plurality of panels 28 which may be pivoted on attachment portion 27 through the plane of the loop (See top insert 14 in FIG. 7). Each of the plurality of panels 28 may carry different indicia or drawings thereon so that the user may manipulate and view the different panels as desired. To facilitate such manipulation, one of the panels 14 may remain fixed with respect to the tube 12 (optionally, with glue, tape, etc.) and the other panel may remain free to rotate through the plane of the loop. Additionally, the plurality of panels may interact such as by including a slot in the fixed panel and a flap in the rotating panel which is inserted therein to create a changing visual impression as the rotating panel rotates through the plane of the loop.

From the proceeding description, it can readily be ascertained that the novelty straw of the present invention may take a wide variety of designs and configurations without departing from the scope of the present invention. Clearly, the insert can be configured in a wide variety of ways, and the loop of the drinking tube can have other configurations than that depicted. For example, the loop could take other than the circular configuration shown so long as it enables liquid passing through the drinking tube to flow unobstructed. Additionally, various conventional novelty effects could be advantageously employed in combination with the insert to create additional eye-catching and amusing effects. Thus, although the present invention have been depicted with reference to certain embodiments and exemplifications thereof, it is not intended to be so limited. Rather, the scope of the present invention is defined by the claims appended hereto and all reasonable equivalents thereof.

I claim:

1. A novelty drinking straw comprising:

a drinking tube defining a hollow, continuous flow passage and including first and second linearly extending end portions, one of said first and second end portions defining a mouthpiece;

a loop defining a plane and disposed on said tube medial of said first and second end portions, said loop being configured to pass through more than 360° of arc for a distance, thereby defining a double looped portion of the loop including an inner passage and an outer passage, said outer passage terminating in an attachment portion transverse with respect to said plane which connects to one of said first and second end portions; and a planar insert including a panel disposed in said loop, said panel having a first cut away portion through which said attachment portion passes such that said insert is retained by said loop, said insert further including at least one section thereof sandwiched between said inner and outer passages such that said insert is prevented from rotating substantially out of the plane of the loop.

2. The straw of claim 1 wherein said first cut away portion is an aperture.

3. The straw of claim 2 wherein said insert further includes a notch formed in said panel and disposed for engagement with the loop.

4. The straw of claim 2 wherein said insert further includes at least two panels, each panel having an aperture formed therethrough so that one of said at least two panels may be rotated in said plane with respect to the other of said at least two panels.

5. The straw of claim 4 wherein said other of said at least two panels is fixed with respect to said loop.

6. The straw of claim 1 wherein said transverse portion passes radially inboard of said inner passage.

7. The straw of claim 1 wherein said transverse portion passes radially outboard of said inner passage.

8. The straw of claim 1 wherein said loop further passes through another 360° of arc to form a triple loop portion of the loop having inner, outer and middle passages, said at least one section of said insert being sandwiched between said middle portion and one of said inner and outer passages.

9. The straw of claim 1 wherein said inner passage of said loop terminates in a second attachment portion transverse with respect to said plane which connects to the other of said first and second end portions.

10. The straw of claim 9 wherein said insert further includes a second cut away portion formed on said panel and disposed diametrically opposite said first cut away portion, said second attachment portion passing through said second cut away portion.

11. The straw of claim 10 wherein one of said first and second cut away portions is an aperture and the other of said first and second cut away portions is a notch.

12. The straw of claim 10 wherein both of said first and second cut away portions are notches.

13. The straw of claim 1 further including a plurality of said drinking tubes each having an associated insert, said tubes including means on at least one of said first and second end portions thereof for connection to an adjacent first or second portion of another of said plurality of drinking tubes.

14. The straw of claim 1 wherein the drinking tube is formed of a resilient, shape retaining material so that said insert may be easily removed and replaced.

* * * * *